US005492271A

United States Patent [19]

Chereton

[11] Patent Number: 5,492,271

[45] Date of Patent: Feb. 20, 1996

[54] REVERSIBLE ENVELOPE

[76] Inventor: Richard Chereton, 1006 Pacific Grove La. #8, Pacific Grove, Calif. 93950

[21] Appl. No.: 122,746

[22] Filed: Sep. 16, 1993

[51] Int. Cl.[6] ..... B65D 27/04; B65D 27/06

[52] U.S. Cl. ..... 229/306; 229/303

[58] Field of Search ..... 229/303, 306

[56] References Cited

U.S. PATENT DOCUMENTS

| | | | |
|---|---|---|---|
| 636,415 | 11/1899 | McCabe . | |
| 1,645,148 | 10/1927 | McCain | 229/303 |
| 1,827,468 | 10/1931 | Guina | 229/303 |
| 1,827,507 | 10/1931 | Brockett | 229/303 |
| 2,588,950 | 3/1952 | Woolsey . | |
| 3,096,925 | 7/1963 | Hiersteiner . | |
| 3,963,174 | 6/1976 | da Lyra . | |
| 3,982,689 | 9/1976 | Retrum . | |
| 4,210,250 | 7/1980 | Yale . | |
| 4,729,507 | 3/1988 | Kim . | |
| 4,917,287 | 4/1990 | Watson . | |
| 5,052,613 | 10/1991 | Lin | 229/303 |

*Primary Examiner*—Stephen P. Garbe
*Attorney, Agent, or Firm*—Colley Godward Castro Huddleton & Tatum

[57] ABSTRACT

A reversible envelope in which sealed, interior envelope spaces are formed from a front panel and from bottom and end panels attached to the front panel that are folded toward each other and attached to each other with a releasible glue and from a flap panel that is attached to the front panel along an integral flap-panel hinge and that comprises a proximal flap portion adjacent the flap-panel hinge and a distal flap portion attached to the proximal flap portion at an integral mid-flap hinge, wherein the flap panel further comprises a cut line connecting two interior points of the mid-flap hinge to form an interior flap panel attached to the proximal flap portion along the mid-flap hinge, wherein the interior flap panel is releasibly attachable to a first exterior envelope surface while the distal flap portion is folded into the interior of the first folded form of the envelope and the distal flap portion is attachable to a second exterior envelope surface after the interior flap panel is released and the envelope is opened and refolded.

15 Claims, 11 Drawing Sheets

REVERSIBLE ENVELOPE

TECHNICAL FIELD

This invention is in the field of mailing envelopes.

BACKGROUND

The concept of reversible mailing envelopes that can be closed and mailed to the receiver, after which the receiver can then open the envelope and use the same envelope for a return mailing, is quite old, patents having been granted on this concept in the United States at least as early as 1899 (U.S. Pat. No. 636,415). Prior to the development of releasable and reusable glues, envelope closures were generally effected by tongue-and-eye closures of the type now commonly found on larger so-called clasp envelopes (such as a 9"×12"number 9 envelope).

With the development of releasable adhesives, simplified reversible envelopes were developed, such as the reversible envelope described in U.S. Pat. No. 4,210,250 to Robert S. Yale which used a combination of releasable and permanent adhesives in the preparation of an envelope that could be opened to a flat envelope blank and refolded in the opposite direction to produce an envelope in which the original interior of the envelope now formed the exterior of the re-folded envelope.

Additional improvements continued to be made, generally relating to the portion of the envelope referred to as the flap. One of the problems that has arisen with reversible envelopes that resemble standard letter envelopes is the tendency of the user to open them in a manner that destroys the reusable nature of the envelope, such as by tearing off an end of the envelope or by opening the top with a letter opener. To avoid this problem, recent envelope flaps have been developed that can be opened by a pull tab or similar feature which is readily apparent to the user, thereby ensuring that the envelope is opened in a manner which allows its reuse. For example, U.S. Pat. No. 4,917,287 to William W. Watson describes a reversible envelope in which the flap comprises a pull-tab portion which both opens the flap of the envelope and makes accessible an adhesive area that can be used to reseal the envelope when the envelope is refolded for returning to the sender. Unfortunately, the envelope flap in this patent is prepared from two body members that must be attached to each other by an adhesive, which increases the expense and difficulty of manufacture.

Additionally, designs that provide for easy opening of the return envelope are very useful, since bulk opening of return envelopes is a time consuming process.

New designs that simplify construction while still retaining the desirable characteristics of providing the recipient of the envelope with an opening technique that discourages non-reusable opening maneuvers and providing an easy-opening return envelope, are therefore desirable.

SUMMARY OF THE INVENTION

Accordingly, it is an object of the invention to provide a reversible envelope with a pull-tab opening feature that is readily prepared from a single-sheet envelope blank.

It is a further object of the invention to provide a reversible envelope that is easily opened when in the from of a return envelope.

These and other objects of the invention have been accomplished by providing a reversible envelope in which sealed, interior envelope spaces are formed from a front panel and from bottom and end panels attached to the front panel that are folded toward each other and attached to each other with a releasible glue and from a flap panel that is attached to the front panel along an integral flap-panel hinge and that comprises a proximal flap portion adjacent the flap-panel hinge and a distal flap portion attached to the proximal flap portion at an integral mid-flap hinge, wherein the flap panel further comprises a cut line connecting two interior points of the mid-flap hinge to form an interior flap panel attached to the proximal flap portion along the mid-flap hinge, wherein the interior flap panel is releasibly attachable to a first exterior envelope surface while the distal flap portion is folded into the interior of the first folded form of the envelope and the distal flap portion is attachable to a second exterior envelope surface after the interior flap panel is released and the envelope is opened and refolded. When the return envelope is formed in this manner, a void space is present in the middle of the sealed flap of the return envelope, which provides access for the tip of automated envelopeopening equipment.

BRIEF DESCRIPTION OF THE DRAWINGS

The present invention will be better understood by reference to the following detailed description of specific embodiments when considered in combination with the drawings that form part of this specification, wherein.

DESCRIPTION OF SPECIFIC EMBODIMENTS

Figure 1:
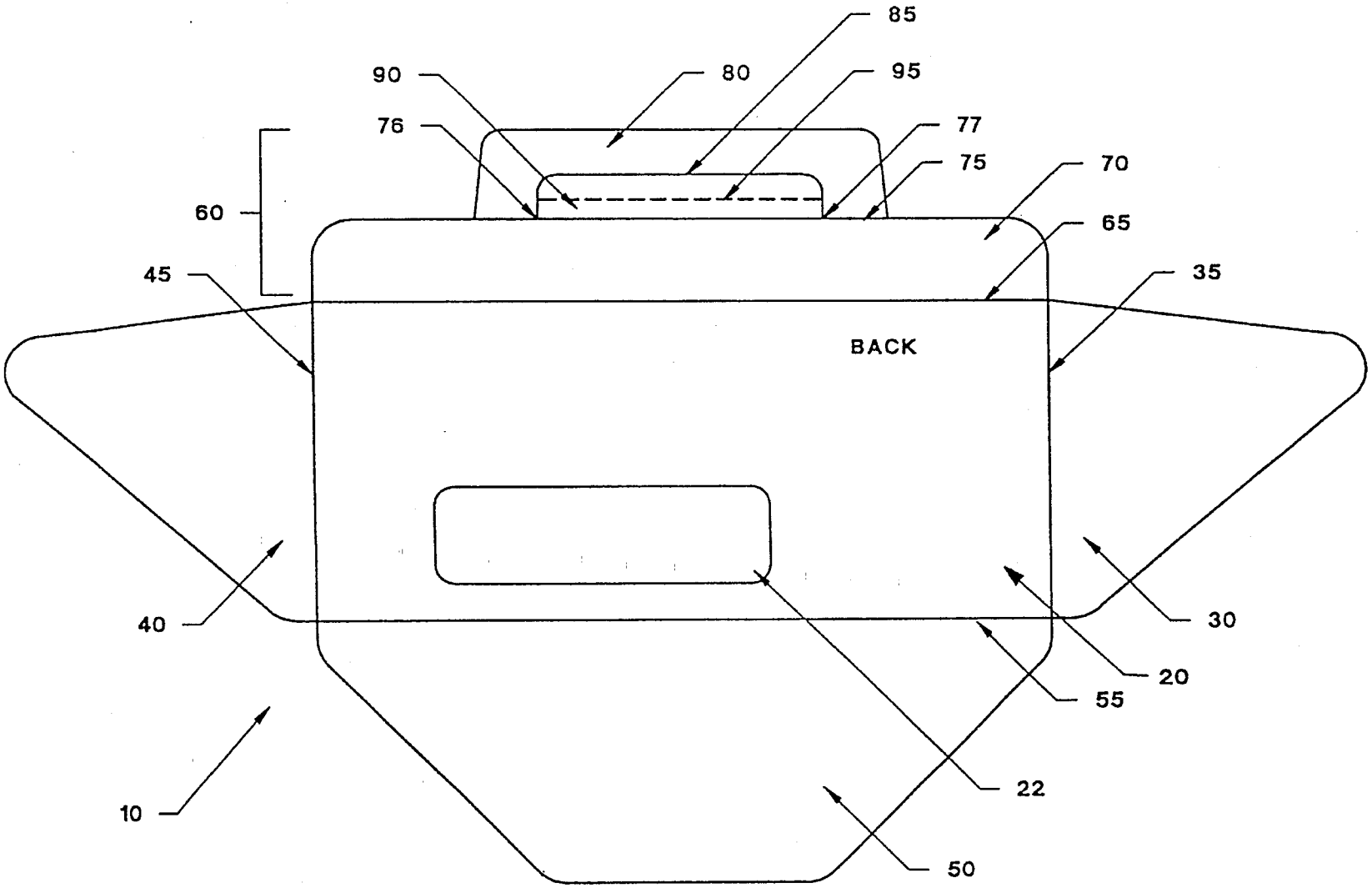
FIG. 1 shows the back (first interior) face of a first embodiment of a reversible envelope of the present invention prior to initial folding.

The structure and operation of the reversible envelope of the invention can be best understood by reference to the figures in combination with the following description. As shown in FIG. 1, the reversible envelope of the invention can be formed from a singlepiece envelope blank. FIG. 1 is a back view of an un-folded (flat) envelope blank. The view is shown from the back face of the envelope blank, since the folds will be toward this back face in order to have the front face of the envelope blank appear on the outside of the initially formed envelope. Reversible envelope 10 is formed from a front panel 20 that can optionally have a cut window opening 22 formed therein, which is used in the standard manner when the address of the original or return addressee will be provided on the documents enclosed in the envelope rather than on the envelope itself. The remaining figures are shown without this optional window opening 22. In the windowless form either the addresses can be pre-printed on the respective faces of the front panel or appropriate locations on the faces can be left blank for later insertion of the address or return address (usually by the first recipient).

A number of panels that form the back of the closed envelope are shown attached to the different edges of front panel 20. Left side panel 30 and right side panel 40 (left and right as reviewed from the front of front panel 20) are shown attached to front panel 20 at fold lines 35 and 45, respectively. These fold lines can also be referred to as integral hinges, since the panels rotate around each fold line as if a hinge were present at that location. In a similar manner, bottom panel 50 is attached at fold line 55 and flap panel 60 is attached at fold line 65.

Details of some of the other panels will be described later, but this specification will first describe flap panel 60, since this panel is subdivided into a number of parts that are important to the operation of the invention. In describing these parts, various portions of the overall flap panel are referred to as being either "proximal" or "distal" to front panel 20. "Proximal" refers to the portion of a given panel that is directly attached to (in this case) front panel 20, in the case of flap panel 60 at fold line 65. More distant portions of the panel are referred to as "distal," which refers to portions of the panel attached, instead of directly to front panel 20, to the proximal portion of the same panel. Proximal and distal are therefore relative terms, and their usage will be apparent from the context and the figures. Proximal and distal are also used to describe portions of other panels or sub-panels, as will be apparent in later descriptions.

Flap panel 60 is principally composed of a proximal portion 70 and a distal portion 80, which are joined together along fold line 75. A cut that forms an interior flap panel is present in the paper or other material that forms flap panel 60, shown in FIG. 1 as cut line 85. The cut occurs between two points 76 and 77 in the interior of fold line 75. In the embodiment shown, cut line 85 appears entirely in distal portion 80 of flap panel 60, but it is also possible to have cut line 85 appear within proximal portion 70 of flap panel 60 or to divide distal portion 80 into three parts (which will occur when cut line 85 extends to the upper edge of distal portion 80 before returning to fold line 75). Such embodiments are discussed later in more detail. Cut line 85 does not cross itself, so that, when considered in combination with fold line 75, an interior flap panel 90 is defined by cut line 85 and the portion of fold line 75 between points 76 and 77. Interior panel 90 is itself divided into a proximal and distal portion relative to fold line 75 as shown by dash line 95 in FIG. 1, in certain embodiments defined later. Further details of interior panel 90 are shown in FIGS. 3–6 below.

Figure 2:
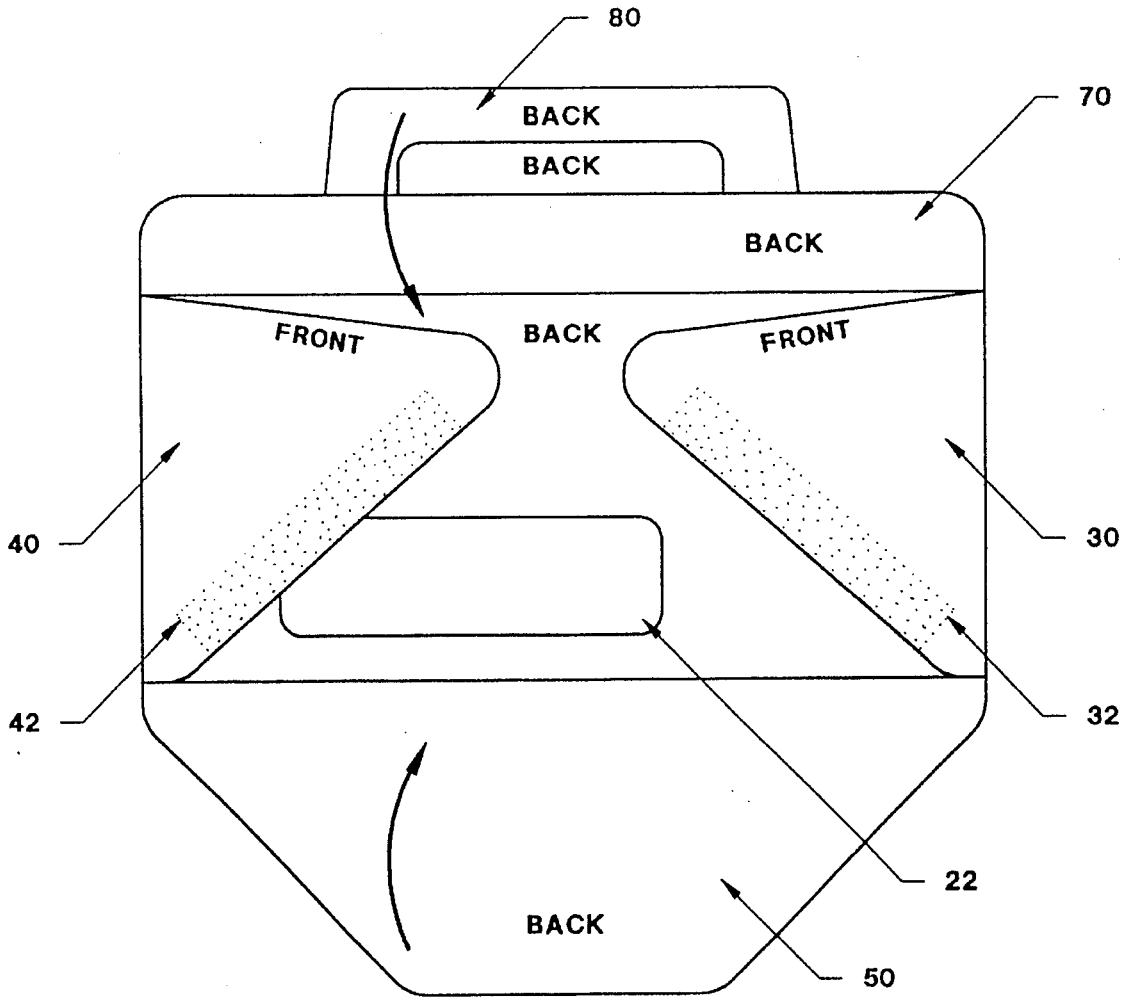
FIG. 2 shows the embodiment of FIG. 1 after partial folding.

FIG. 2 is a view of the embodiment shown in FIG. 1 after the initial folding operation, in which side panels 30 and 40 have been folded along hinge lines 35 and 45 toward the back face of front panel 20. In this orientation, adhesive regions 32 and 42 are visible on the front faces of panels 30 and 40, respectively. The glue (adhesive) shown on panels 32 and 42 is used to reversibly attach bottom panel 50 to the two side panels 30 and 40 to form the interior space of the envelope. It will be apparent to one of ordinary skill in the art that the adhesive can be present either in the adhesive regions shown (32 and 42), in corresponding locations on bottom panel 50 where bottom panel 50 will overlap side panels 30 and 40 after folding, or in all of such locations. A releasable adhesive can be used on either or both of the contact surfaces between a side panel and a bottom panel, depending on the type of adhesive being used. Such adhesives are well known and are not part of the present invention. See, for example, U.S. Pat. No. 4,917,287, which describes similar releasable adhesives for securing various panels of a different reversible envelope.

Figure 3:
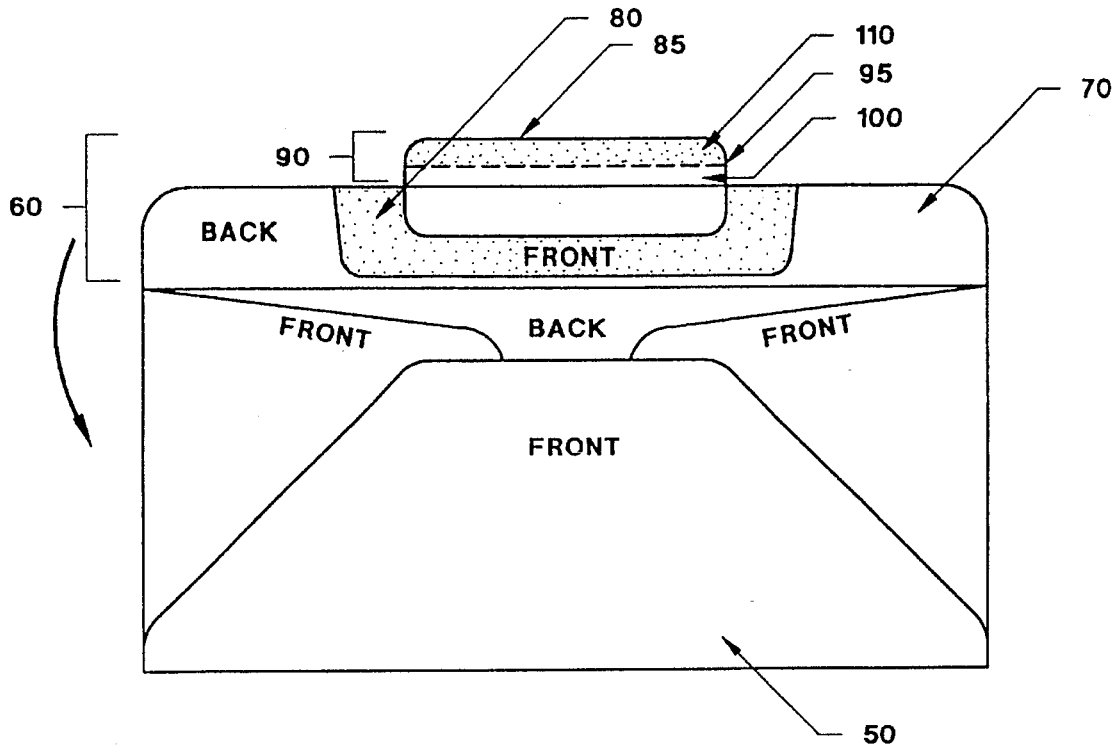
FIG. 3 shows the embodiment of FIGS. 1 and 2 after further folding.

FIG. 3 shows the same envelope embodiment after two additional folding operations. Bottom panel 50 has been folded upward toward the back of front panel 20 so that the edges of panel 50 contact and overlap with adhesive regions 32 and 42 on side panels 30 and 40, respectively. Additionally, distal portion 80 of flap panel 60 has been folded downward toward the back of the proximal portion 70 of flap panel 60. Interior flap panel 90 remains in its original position, since the interior panel 90 is separated from distal flap panel 80 by cut line 85.

Additional detail present on interior flap panel 90 can also be seen in FIG. 3. As previously indicated, interior flap panel 90 is divided into two portions along line 95; these are referred to as a proximal portion 100 and a distal portion 110. In the embodiment shown, an adhesive is present on the back face of distal portion 110 (which faces the viewer in FIG. 3), with no adhesive being present on proximal portion 100. As shown in FIG. 4, which again represents the same embodiment as in FIGS. 1–3, the adhesive present at distal portion 110 is used to attach the flap panel to the bottom panel, thereby sealing the envelope for its first use.

It should be noted that the reversible envelope of the invention can be stuffed with documents either before or after distal portion 80 of flap panel 60 is folded against proximal portion 70. Additionally, it will be apparent that the shape of distal portion 80 is not limited to the specific shape shown but can vary significantly as long as the guidelines provided herein are followed. For example, distal portion 80 can have the same width as proximal portion 70.

Figure 4:
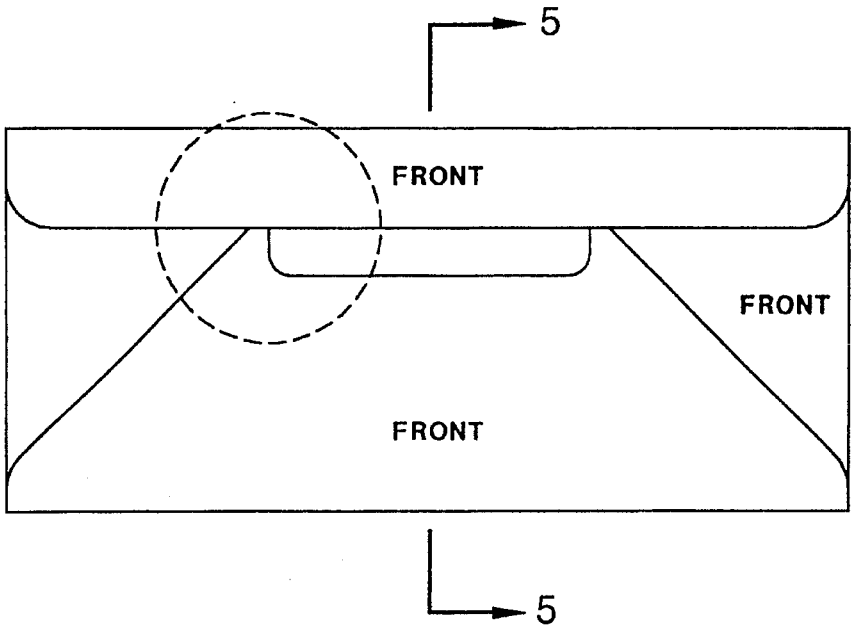
FIG. 4 shows the embodiment of FIGS. 1–3 in its folded and sealed form.
Figure 5:
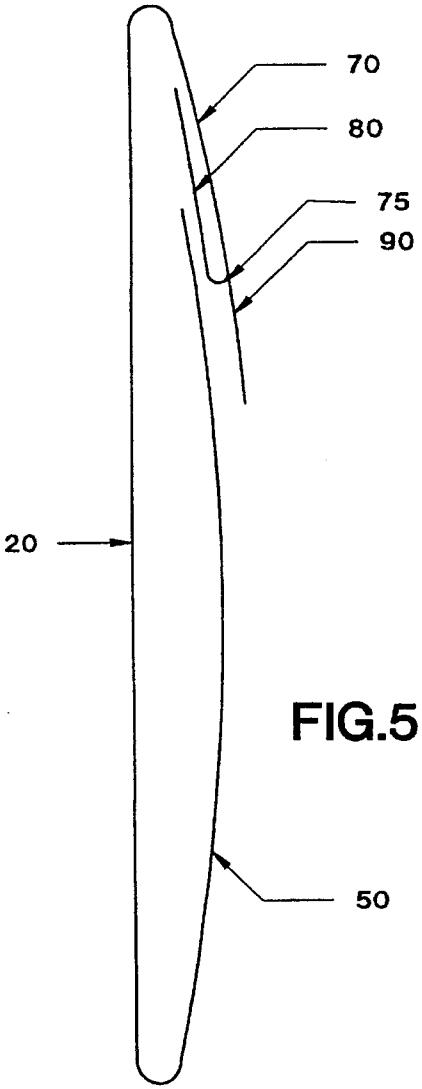
FIG. 5 is a vertical cross-sectional view of the embodiment shown in FIG. 4 taken along line 5—5 and showing the position of different portions of the flap when folded and sealed.

FIG. 5 is a vertical cross-sectional view of the embodiment shown in FIG. 4 taken along line 5—5. Front panel 20 is shown to the left of FIG. 5, with the various panels making up the back of the envelope shown to the fight of the figure. As can be 4 seen in this figure, distal portion 80 of flap panel 60 has been folded so that it now is present in the interior of the envelope. It can also be seen, both in FIG. 5 and in FIG. 3 above, that this folded position protects adhesive on the top portion 80 from being handled by the recipient of the envelope without requiring extra protective coverings, such as a removable adhesive-protecting panel, which is used in some reversible envelopes. Attachment of interior flap panel 90 to bottom panel 50 occurs via flap-panel distal portion 110 and the adhesive present on this region of the panel.

Figure 6:
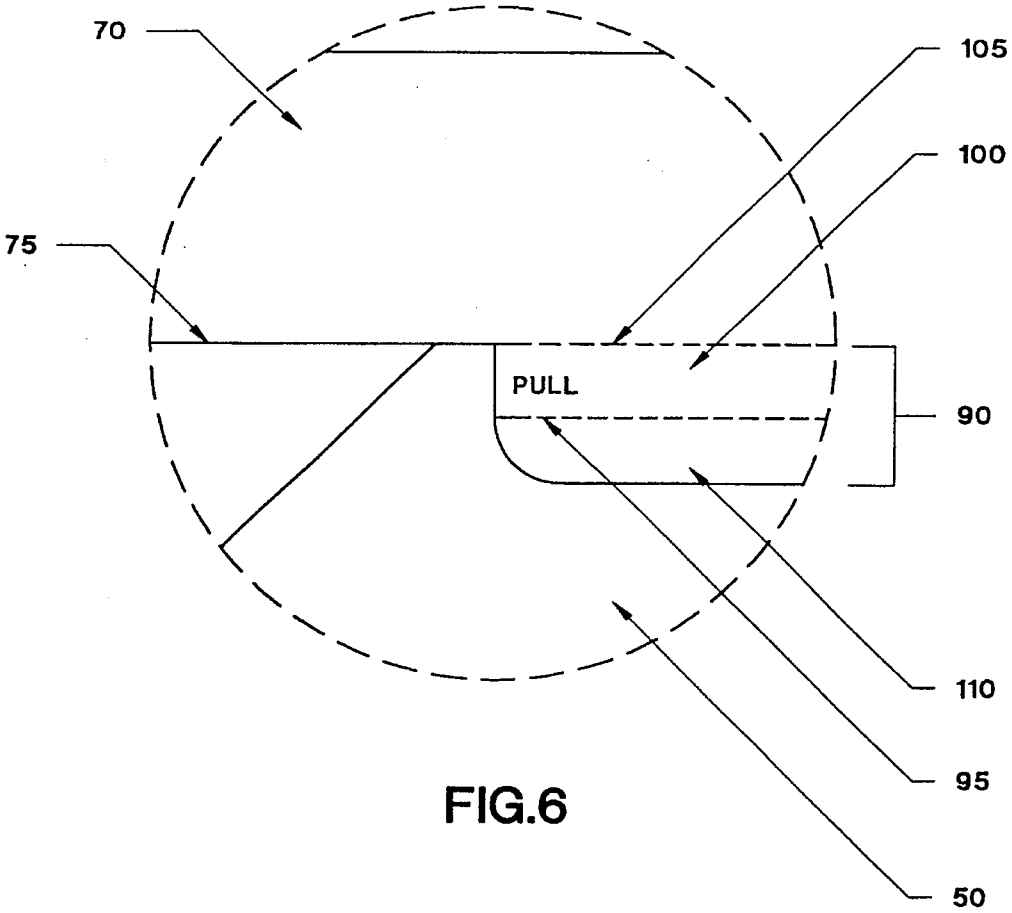
FIG. 6 is a detail of the embodiment shown in FIG. 4 showing features of the pull-tab.

FIG. 6 is a magnified view of the area encircled by a dashed line on the embodiment shown in FIG. 4. FIG. 6 principally shows one embodiment of a pulltab that can be prepared from interior panel 90. In FIG. 6, proximal portion 70 of flap panel 60 is attached to bottom panel 70 by the adhesive present on the side of distal portion 110 of interior flap panel 90 not visible to the viewer (i.e., the back face). No adhesive is present on proximal portion 100 of the interior flap panel which joins the proximal portion 70 of the flap panel to the distal portion 110 of the interior flap panel 90. Two perforation lines are present, a first perforated line 95 (each perforation being indicated by one of the dashes forming line 95 in this figure), and a second perforated line 105 along the portion of line 75 adjacent to interior flap panel 90. The word "pull" can be printed on the ends of the tear panel as shown in FIG. 6. The ends of the tear panel can be pulled upward since the end perforations extend to the edges of interior flap panel 90. When an end of this tear panel is grasped and pulled upward, the tear panel formed by proximal interior flap panel 100 is removed, thereby separating the flap panel from the bottom panel and allowing the envelope to open.

In an alternative pull-tab embodiment (not shown for this first embodiment but shown in detail in a later embodiment shown in FIG. 15), adhesive can be present on the front face of distal portion 110 rather than on the back face as shown in FIGS. 3–6. Such an embodiment offers an advantage in that all of the adhesive is applied to the same face of flap panel 60 and can thus be applied in a single operation without turning over or otherwise manipulating the envelope blank between applications of adhesive. However, in such cases an additional folding operation will be required so that the proper face of distal portion 110 contacts the outside of the first-formed envelope. To achieve the proper orientation, one merely folds distal portion 110 forward along fold line 95 while the envelope is at the stage shown in FIG. 3 without making a fold along fold line 105. When flap panel 60 is later folded forward to provide the sealed envelope shown in FIG. 4, interior flap panel 90 is then oriented correctly so that the adhesive on distal portion 110 properly contacts the outside of the envelope.

Figure 7:
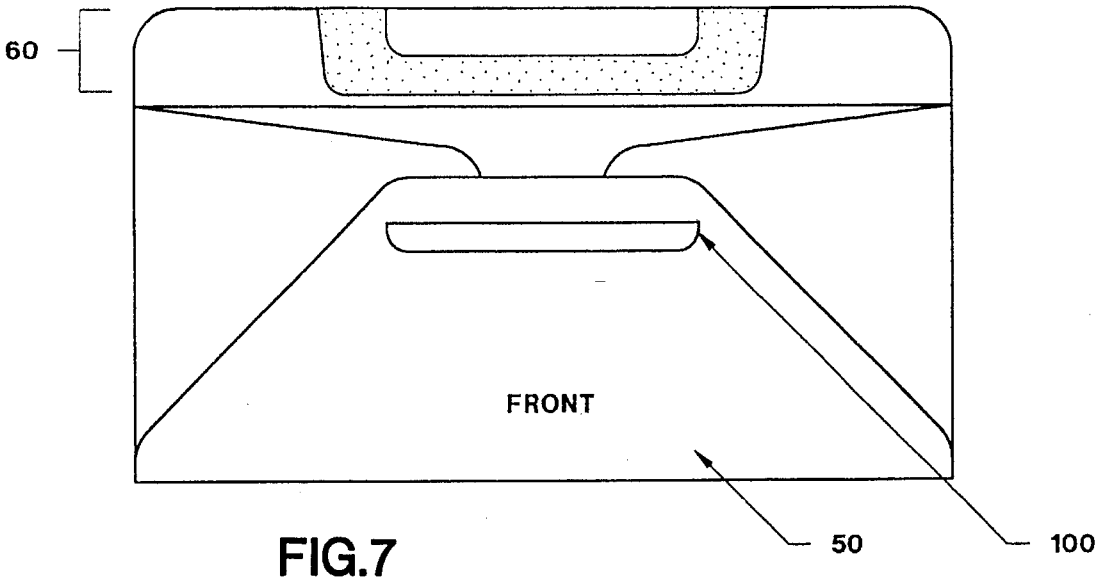
FIG. 7 is a view of the opened envelope after the pull-tab has been removed and the flap has been folded upward for removal of the contents of the envelope.

The opened envelope is shown in FIG. 7. Adhesive panel 100 remains attached to bottom panel 50 while flap panel 60 has been folded upward to allow access to the interior of the envelope.

Figure 8:
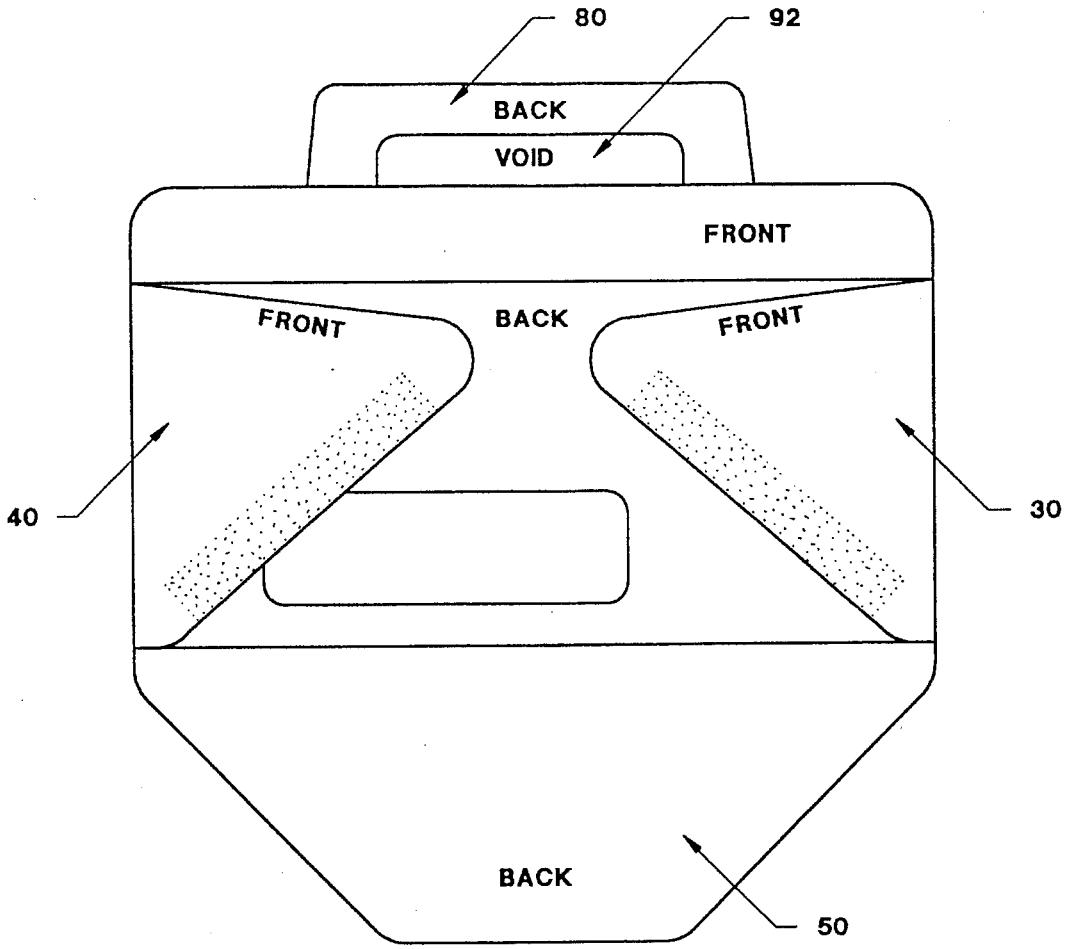
FIG. 8 is a view of the partially opened envelope after the bottom panel has been detached from the side panels.

The remaining operations described below are related to the unfolding and refolding of the envelope so that it can be returned to the original sender (or some other location). FIG. 8 shows the orientation of the embodiment shown in the previous figures after bottom panel 50 has been released from the adhesives that attach it to end panels 30 and 40. The distal portion 80 of flap panel 60 has also been folded upward and forms what appears to be a "handle" with a void interior space 92 previously occupied by interior flap panel 90.

Figure 9:
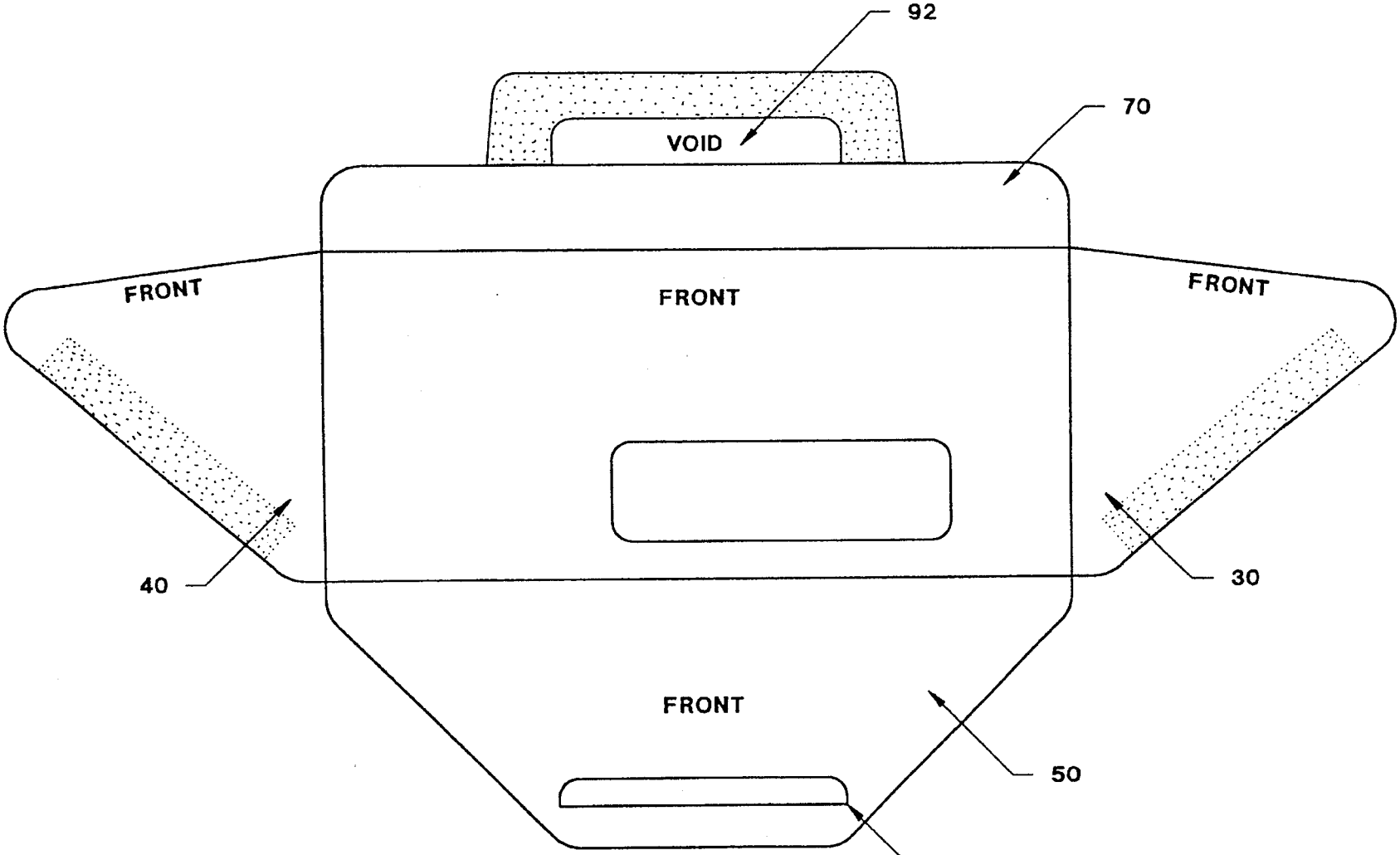
FIG. 9 is a view of the embodiment shown in FIG. 8 after the side slaps have been fully opened to provide a flat envelope blank and the envelope blank has been turned over so that the front side of the envelope blank now faces the viewer.

After side panels 30 and 40 have been folded outward from the position shown in FIG. 8 and the envelope blank has been turned over, the resulting envelope has the form shown in FIG. 9. This is the opposite side of the view shown in FIG. 1, with the exceptions that a void space 92 is present at the original location of internal flap panel 90 and distal portion 100 of internal flap panel 90 remains attached to the front face of bottom panel 50. The various faces of the panels now in view are the front faces which will form the interior of the envelope when it is used as a return envelope.

Figure 10:
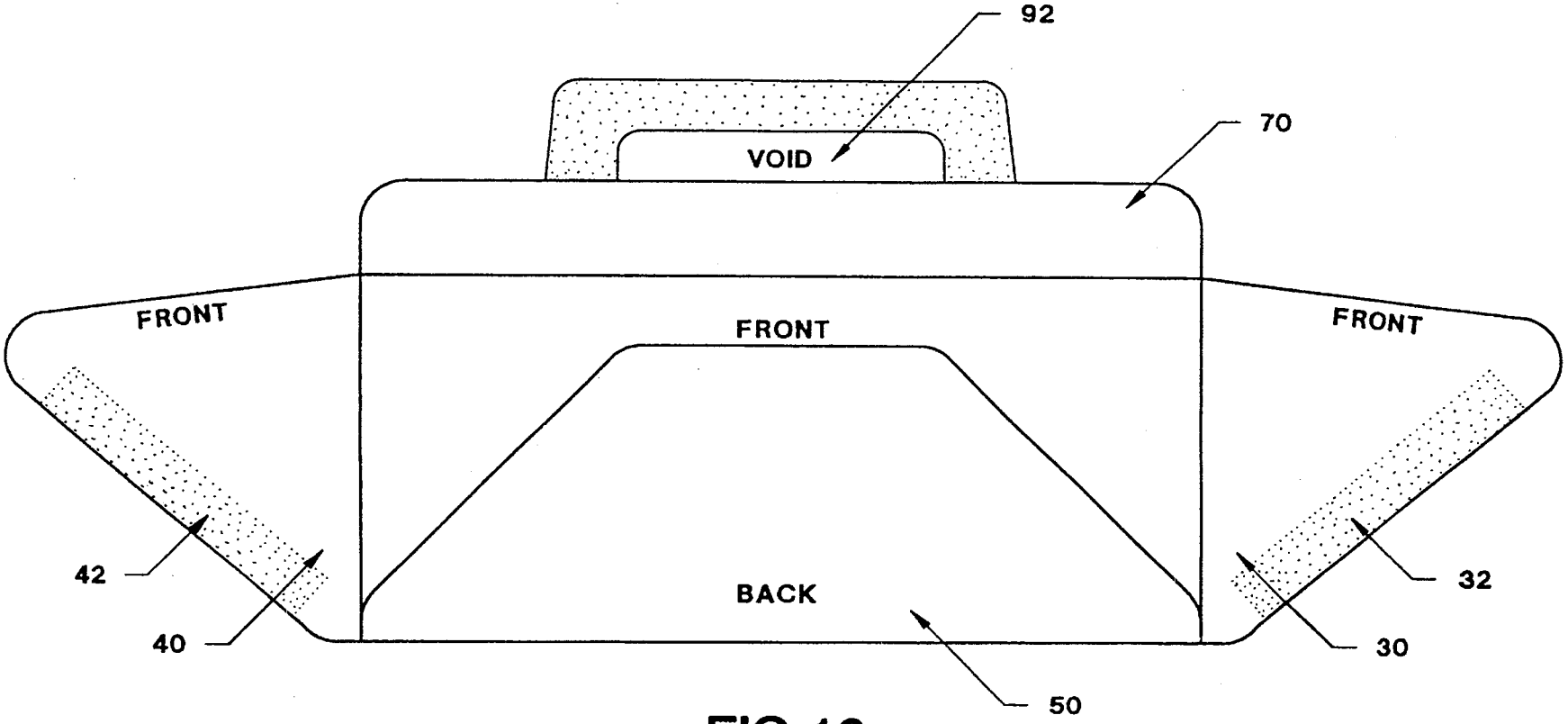
FIG. 10 is a view of the same embodiment in which the bottom flap has been folded upward in the process of refolding the envelope.
Figure 11:
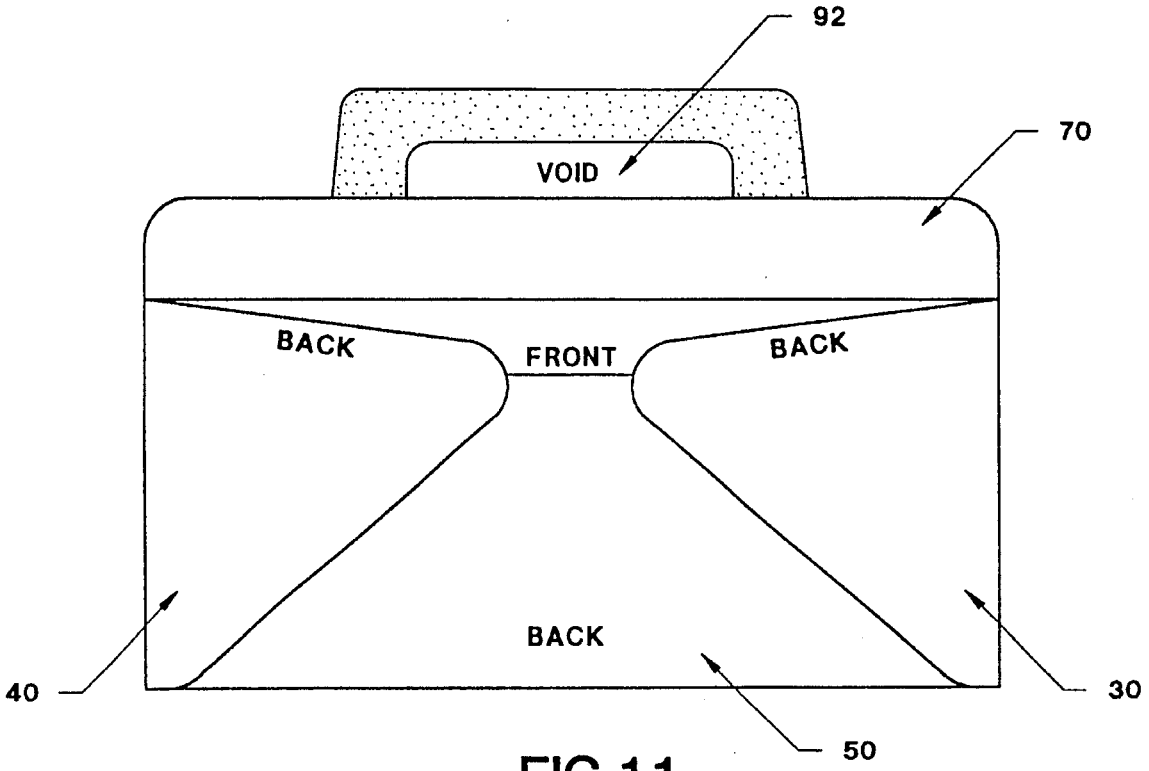
FIG. 11 is a further view of the same embodiment in which the side panels have been folded inward to form the return envelope interior space.

The initial step of the folding operation for use as a return envelope is shown in FIG. 10. The first fold is of bottom panel 50 in an upward direction toward the front face of front panel 20. Bottom panel 50 is folded prior to end panels (see FIG. 2 and the accompanying description) so that adhesive contact panels 32 and 42 can continue to contact the overlapping portion of bottom panel 50 in this reversed envelope orientation. After the end panels are folded inward, the envelope has the configuration shown in FIG. 11. At this point, any contents of the envelope can be added to the newly formed interior of the envelope. Flap panel 60 is now folded downward as a single unit, and the adhesive present on the front face of distal portion 80 of flap panel 60 is now activated (if necessary). A typical adhesive used here would be a moisture-activated glue, but other types of activation (such as removal of a covering protective film) can also be used. The orientation of the sealed envelope is shown in FIG. 12.

Figure 12:
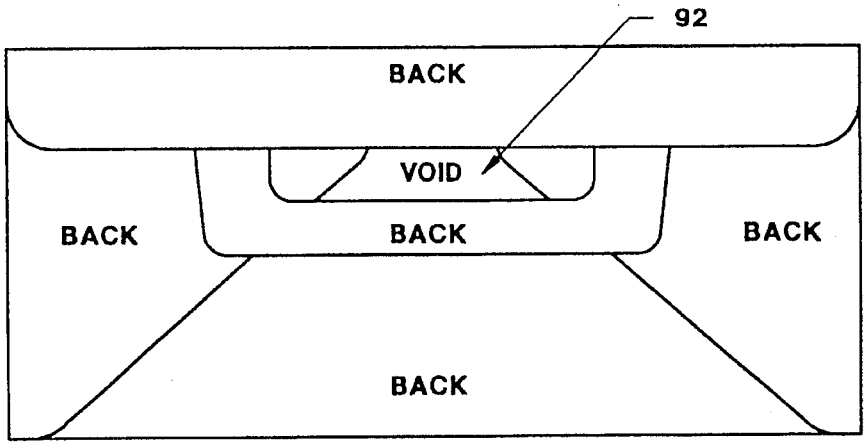
FIG. 12 is a view of the same embodiment in which the flap has been closed and sealed.
Figure 13:
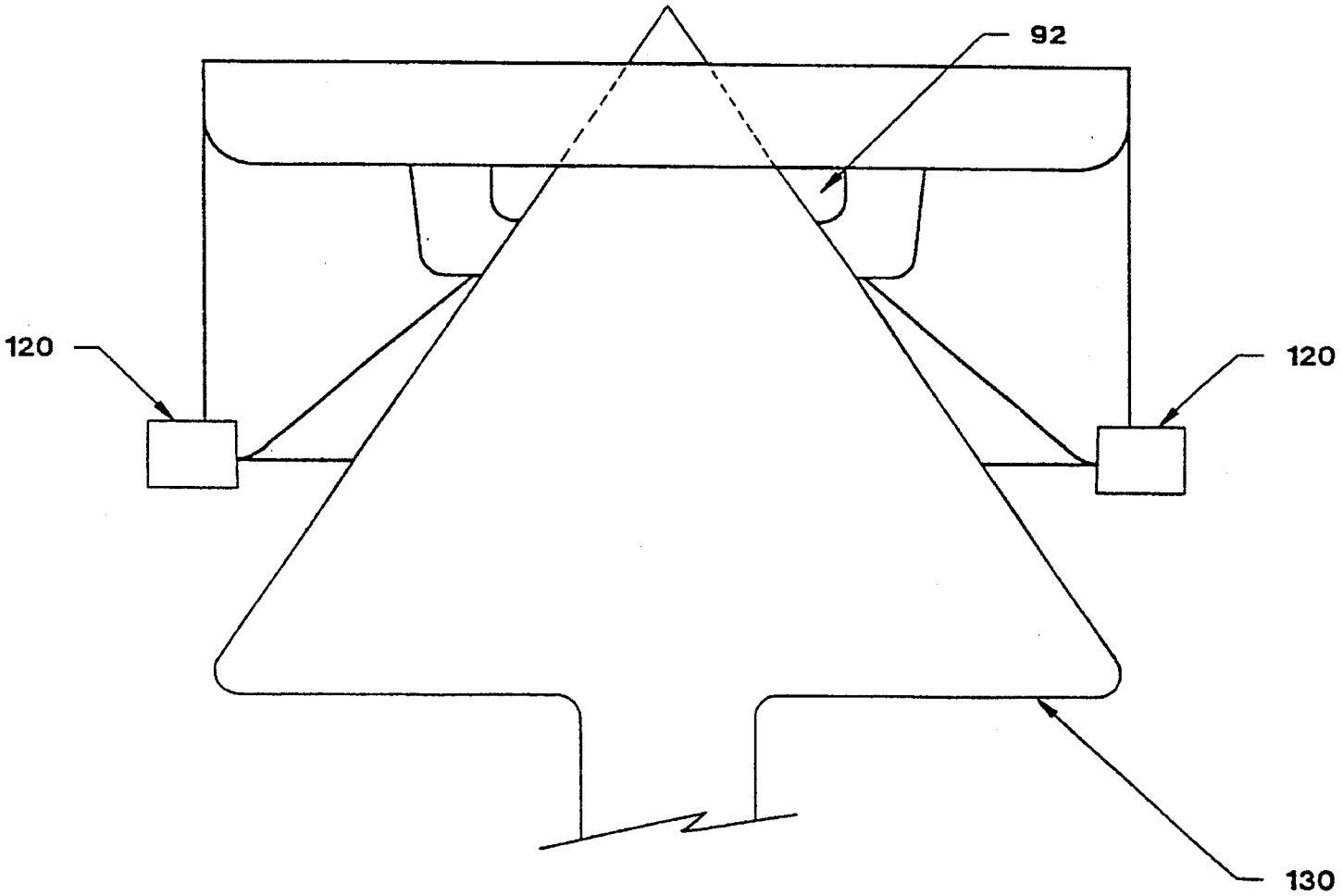
FIG. 13 is a view of a mechanical opener that can be used with the envelope of the invention in an automated opening process.

A particular advantage of the reversible envelope of the invention is shown in FIG. 12. The void space 92 present between portions 70 and 80 of flap panel 60 (i.e., the space previously occupied by interior flap panel 90) can be used with manual or automated opening equipment to provide a new manner of opening envelopes mechanically. Such an opening operation is shown in FIG. 13, which shows an envelope of the invention in its return orientation retained at its lower corners by clamps 120 while a wedge-shaped opening device 130 is inserted into open space 92. Wedge-shaped opener 130 is then forced upward and slices the envelope along lines 65 and 75, thereby completely removing top panel 60 from the envelope (except for distal portion 80 which is attached to bottom panel 50 and is therefore distantly removed from the opening operation). The contents of the envelope can thereafter be removed by further existing automated equipment so that the contents can readily be handled.

It will be apparent that the embodiment shown above is a single example of many different envelopes that can be prepared using the guidelines provided in this specification. In particular, the shapes of the various end and bottom panels can be modified (such as in the patents recited in the specification), as can the shape of the flap panel. When such modifications are made, the location of the adhesives may be different from the precise locations described herein, but the locations on which adhesives will be required will be readily apparent from the contact surfaces that occur when the envelope 4 is folded as described herein. In particular, adhesives can be present on either or both (depending on the adhesive selected by the user) of two contacting surfaces at the points of contact. Adhesives may be present in a broad band or in a pattern (such as "dots" of adhesive). Other variations in shapes and adhesives will be apparent to those of skill in 8 the art of manufacturing envelopes.

Figure 14:
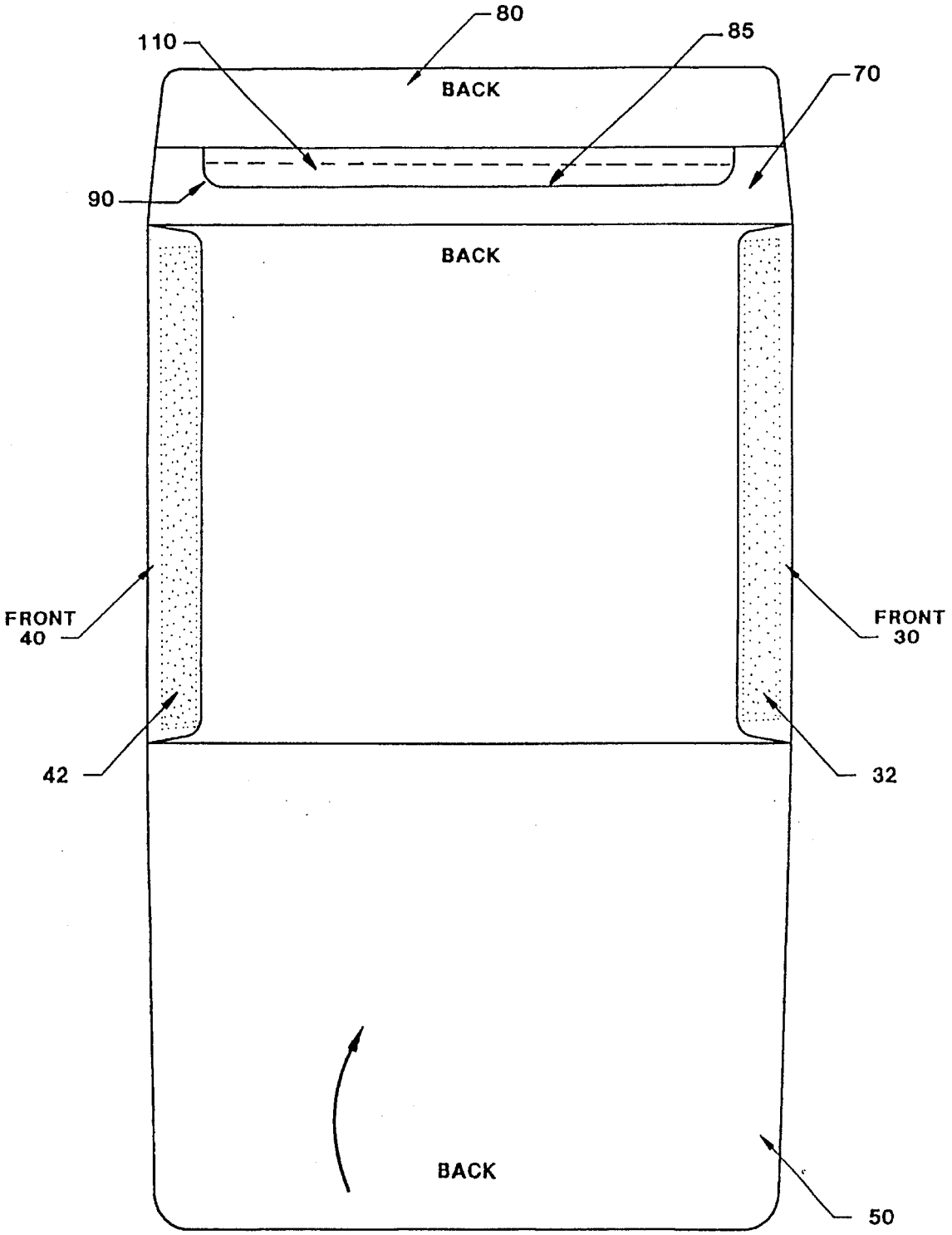
FIG. 14 is a view of a second embodiment of the inventions shown in the same orientation as FIG. 2.

As an example of modifications within the scope of the invention, FIG. 14 shows a second embodiment in which cut line 85 is located in the proximal portion 70 of flap panel 60 rather than in distal portion 80, as in the first embodiment described above. It will be apparent to one of ordinary skill that the folding of interior flap panel 90 occurs in a direction opposite to that of interior flap panel 90 in the first embodiment described above and that the adhesive present on distal flap portion 110 is on the opposite side from that shown for the first embodiment. Other than these differences, the folding and sealing operations are essentially identical for the two embodiments. However, the first embodiment of FIG. 1 is preferred relative to the second embodiment of Figure 14, since the embodiment of FIG. 14 will have an opening in the flap accessible to the first recipient that may tempt the first recipient to open the envelope in a manner that will void the reusable aspects of the envelope. Nevertheless, the embodiment of FIG. 14 provides many of the same advantages already described for the embodiment of FIG. 1.

Figure 15:
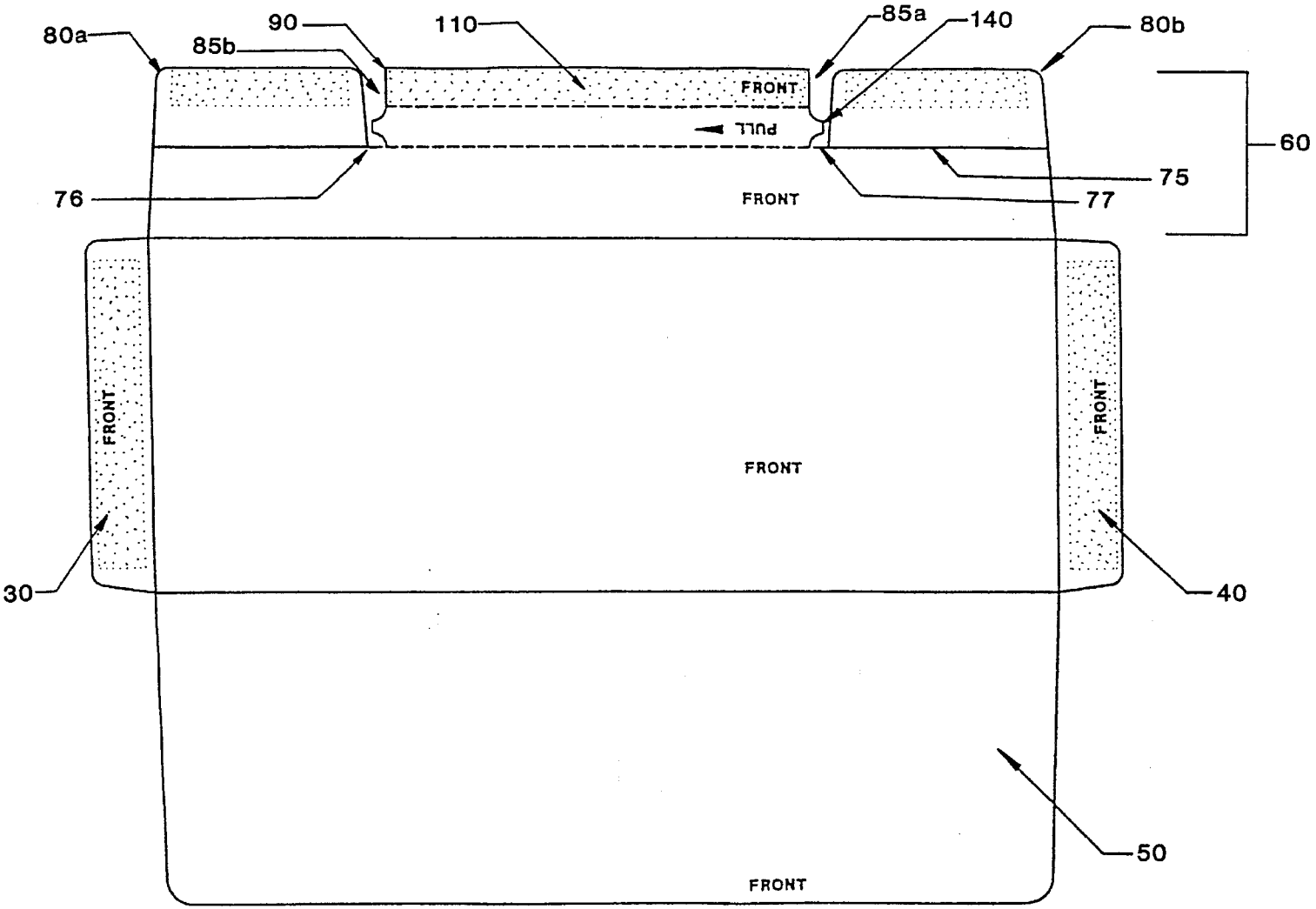
FIG. 15 is a view of a third embodiment of the invention shown prior to folding in the same orientation as FIG. 1 but viewed from the front face rather than the back face.

A third embodiment is shown in FIG. 15. This embodiment is shown with its front face toward the viewer prior to folding in order to show how adhesive (shown by the shaded areas) can be applied to a single side of the envelope prior to the folding operation. In this embodiment, cut line 85*a* on the right side of the blank extends between fold line 75 and the upper edge of flap panel 60, forming distal portion 80*b*. Cut line 85*b* on the left side of the blank also extends between fold line 75 and the upper edge of flap panel 60, forming distal portion 80*a*. Distal portion 80 is now divided into three segments. The middle segment functions in the same manner as interior flap panel 90 of the previous embodiments and is referred to by the same number because of this similarity in function. The two side panels 80*a* and 80*b* have the same function and are folded and glued in the same manner as distal portion 80 of the two embodiments previously described. It can be seen in FIG. 15 that cut line 85 can have a physical width, as would occur by cutting out a wedge instead of cutting along a single line. Since the envelope blanks used to form the envelopes of the invention are generally cut by a stamping process, this wedge-like cut can be obtained in the same stamping operation that is used to form the remainder of the envelope. As shown in FIG. 15, such a cutting operation allows a pull-tab 140 to be formed that is easier to grasp than those previously illustrated.

All operations relating to the folding and use of the envelope are the same for the embodiments shown in FIG. 15 and in FIG. 1, except that distal portion 80 of flap panel 60 in FIG. 1 is replaced by two distal portions 80*a* and 80*b* in FIG. 15, with the single-sided gluing operation requiring the additional folding under of the distal portion 110 of interior flap panel 90 as previously described.

FIGS. 14 and 15 further illustrate two of the many variations in the shape of the overall envelope 10 of the invention as well as variations in the shape and appearance of the various bottom and end panels attached to the front panel.

The foregoing examples are illustrative of the invention and are not intended to limit the invention unless so described and claimed. Since numerous modifications and changes will be apparent to those of skill in the art, it is not desired to limit the invention to the exact construction and operation shown and described. Accordingly, modifications and equivalents can be prepared while falling within the scope of the appended claims.

All publications and patent applications mentioned in this specification are herein incorporated by reference to the same extent as if each individual publication or patent application was specifically and individually indicated to be incorporated by reference.

What is claimed is

1. A reversible envelope comprising:

a front panel having a top edge, a bottom edge, a right edge, and a left edge and having front and back front-panel faces;

a bottom panel attached to said bottom edge of said front panel by an integral bottom-panel hinge and having front and back bottom-panel faces;

a first side panel attached to said left edge of said front panel by an integral first-side-panel hinge and having front and back first-side-panel faces;

a second side panel attached to said right edge of said front panel by an integral second-side-panel hinge and having front and back second-side-panel faces; and a flap panel attached to said top edge of said front panel by an integral flap-panel hinge and having front and back flap-panel faces;

wherein said side panels and said bottom panel are foldable along said hinges toward either said front face or said back face of said front panel, whereby said first side panel and said bottom panel contact each other at a first-side-panel contact surface and a first bottom-panel contact surface and said second side panel and said bottom panel contact each other at a second-side-panel contact surface and a second bottom-panel contact surface, thereby forming (1) an open first interior envelope space for receiving documents in which back faces of said panels form the interior of said envelope when said bottom and end panels are folded along said hinges toward said back face of said front panel or (2) an open second interior envelope space for receiving documents in which front faces of said panels form the interior of said envelope when said bottom and end panels are folded along said hinges toward said front face of said front panel, and wherein a releasible glue is present on a sufficient number of said contact surfaces to releasibly attach said contact surfaces to each other; and wherein said flap panel comprises a proximal flap portion adjacent said flap-panel hinge and a distal flap portion attached to said proximal flap portion at an integral mid-flap hinge and wherein said flap panel further comprises a cut line connecting two interior points of said mid-flap hinge to form an interior flap panel attached to said proximal flap portion along said mid-flap hinge, wherein said interior flap panel comprises first means for releasibly attaching said interior flap panel to one or more front face or faces of said bottom or side panel or panels at a first envelope-sealing surface when said envelope is folded to form said first interior envelope space and said distal flap portion comprises second means for attaching said distal flap portion to a second envelope-sealing surface on one or more back faces of said bottom or side panel or panels when said envelope is folded to form said second interior envelope space, and wherein said distal flap portion, when folded along said mid-flap hinge toward said back face of said proximal portion of said flap panel, is located in the interior space of said envelope when said flap panel is folded along said flap-panel hinge toward and is attached to said first envelope-sealing surface by said means for reversibly attaching.

2. The envelope of claim 1, wherein said second means for attaching comprises an activatible adhesive.

3. The envelope of claim 2, wherein said activatible adhesive is moisture activatible.

4. The envelope of claim 1, wherein said second means for attaching comprises a seal-protected adhesive.

5. The envelope of claim 1, wherein said cut line is located entirely in said distal flap portion of said flap panel.

6. The envelope of claim 1, wherein said interior flap panel is detachable from the remainder of said flap panel along said mid-flap hinge.

7. The envelope of claim 1, wherein means for releasibly attaching comprises a releasible glue.

8. The envelope of claim 1, wherein said means for releasibly attaching comprises a non-releasibly glueable tear panel formed from said interior flap panel.

9. The envelope of claim 8, wherein said tear panel is detachable from said flap panel along said mid-flap hinge.

10. The envelope of claim 1, wherein said front panel comprises an envelope address window.

11. The envelope of claim 1, wherein said front face of said front panel and said back face of said front panel are printed with different addresses.

12. The envelope of claim 1, wherein said mid-flap hinge is substantially parallel to said flap hinge.

13. The envelope of claim 1, wherein said distal portion of said flap panel is shorter than said proximal portion.

14. In a reversible envelope in which an interior envelope space is formed from bottom and end panels folded toward each other and attached to each other with a releasible glue, an improvement which comprises:

a flap panel attached to said envelope along an integral flap-panel hinge and comprising a proximal flap portion adjacent said flap-panel hinge and a distal flap portion attached to said proximal flap portion at an integral mid-flap hinge, wherein said flap panel further comprises a cut line connecting two interior points of said mid-flap hinge to form an interior flap panel attached to said proximal flap portion along said mid-flap hinge, wherein said interior flap panel comprises first means for releasibly attaching said interior flap panel to a first exterior envelope-sealing surface when said envelope is folded to form a first interior envelope space and said distal flap portion comprises second means for attaching said distal flap portion to a second exterior envelope-sealing surface after said envelope is refolded to form a second interior envelope space, and wherein said distal flap portion, when folded along said mid-flap hinge toward said back face of said proximal portion of said flap panel, is located in the first interior space of said envelope when said flap panel is folded along said flap-panel hinge toward, and is attached to, said first envelope-sealing surface by said means for reversibly attaching.

15. A reversible envelope comprising:

a front panel having a top edge, a bottom edge, a right edge, and a left edge and having front and back front-panel faces;

a bottom panel attached to said bottom edge of said front panel by an integral bottom-panel hinge and having front and back bottom-panel faces;

a first side panel attached to said left edge of said front panel by an integral first-side-panel hinge and having front and back first-side-panel faces;

a second side panel attached to said right edge of said front panel by an integral second-side-panel hinge and having front and back second-side-panel faces; and a flap panel attached to said top edge of said front panel by an integral flap-panel hinge and having front and back flap-panel faces;

wherein said side panels and said bottom panel are foldable along said hinges toward either said front face or said back face of said front panel, whereby said first side panel and said bottom panel contact each other at a first-side-panel contact surface and a first bottom-panel panel contact surface and said second side panel and said bottom panel contact each other at a second-side-panel contact surface and a second bottom-panel contact surface, thereby forming (1) an open first interior envelope space for receiving documents in which back faces of said panels form the interior of said envelope when said bottom and end panels are folded along said hinges toward said back face of said front panel or (2) an open second interior envelope space for receiving documents in which front faces of said panels form the interior of said envelope when said bottom and end panels are folded along said hinges toward said front face of said front panel, and wherein a releasible glue is present on a sufficient number of said contact surfaces to releasibly attach said contact surfaces to each other; and wherein said flap panel comprises a proximal flap portion adjacent said flap-panel hinge and a distal flap portion attached to said proximal flap portion at an integral mid-flap hinge and wherein said flap panel further comprises two cut lines each of which extends between an interior point of said mid-flap hinge and the upper edge of said flap panel thereby dividing said distal flap portion into an interior flap panel and two exterior flap panels, wherein said interior flap panel comprises first means for releasibly attaching said interior flap panel to one or more front face or faces of said bottom or side panel or panels at a first envelope-sealing surface when said envelope is folded to form said first interior envelope space and said distal flap portion comprises second means for attaching said distal flap portion to a second envelope-sealing surface on one or more back faces of said bottom or side panel or panels when said envelope is folded to form said second interior envelope space, and wherein said distal flap portion, when folded along said mid-flap hinge toward said back face of said proximal portion of said flap panel, is located in the interior space of said envelope when said flap panel is folded along said flap-panel hinge toward and is attached to said first envelope-sealing surface by said means for reversibly attaching.

* * * * *